US005986238A

United States Patent [19]

Struble

[11] Patent Number: 5,986,238

[45] Date of Patent: Nov. 16, 1999

[54] APPARATUS AND METHOD FOR THERMALLY PROCESSING AN IMAGING MATERIAL EMPLOYING MEANS FOR REDUCING FOGGING ON THE IMAGING MATERIAL DURING THERMAL PROCESSING

[75] Inventor: Kent R. Struble, Mahtomedi, Minn.

[73] Assignee: Imation Corporation, St. Paul, Minn.

[21] Appl. No.: 08/769,430

[22] Filed: Dec. 19, 1996

[51] Int. Cl.[6] ..... B03G 15/20

[52] U.S. Cl. ..... 219/216; 399/331

[58] Field of Search ..... 219/216, 469–471; 399/328–332, 335–338; 432/60, 228; 492/46; 118/60

[56] References Cited

U.S. PATENT DOCUMENTS

| | | | |
|---|---|---|---|
| 3,570,383 | 3/1971 | Berg | 396/579 |
| 3,629,549 | 12/1971 | Svendsen | 219/216 |
| 3,648,019 | 3/1972 | Brewitz | 219/386 |
| 3,709,472 | 1/1973 | Kreitz et al. | 263/6 E |
| 3,727,534 | 4/1973 | Low, Jr. et al. | 396/579 |
| 3,739,143 | 6/1973 | Amundson et al. | 219/216 |
| 3,774,520 | 11/1973 | Smith et al. | 95/89 R |
| 3,798,790 | 3/1974 | Roman | 34/155 |
| 4,076,532 | 2/1978 | Gottermeier . | |
| 4,242,566 | 12/1980 | Scribner | 219/216 |
| 4,255,037 | 3/1981 | Meadows et al. | 396/579 |
| 4,313,666 | 2/1982 | Koblo et al. | 396/574 |
| 4,377,331 | 3/1983 | Seelenbinder et al. | 396/579 |
| 4,473,282 | 9/1984 | Michlin | 396/579 |
| 4,518,845 | 5/1985 | Svendsen | 219/216 |
| 4,644,667 | 2/1987 | Yanagi et al. | 34/54 |
| 4,890,136 | 12/1989 | Greene et al. | 355/27 |
| 5,068,684 | 11/1991 | Abe et al. | 355/27 |
| 5,097,605 | 3/1992 | Kashino et al. | 397/579 |
| 5,352,863 | 10/1994 | Svendsen | 219/388 |
| 5,469,238 | 11/1995 | Biegler | 396/579 |
| 5,510,871 | 4/1996 | Biegler et al. | 396/579 |
| 5,563,681 | 10/1996 | Kirkwold et al. | 355/30 |
| 5,600,396 | 2/1997 | Biegler et al. | 396/579 |

FOREIGN PATENT DOCUMENTS

| | | |
|---|---|---|
| 0 679 946 A1 | 11/1995 | European Pat. Off. . |
| 0 679 947 A1 | 11/1995 | European Pat. Off. . |

*Primary Examiner*—Joseph Pelham

*Attorney, Agent, or Firm*—William K. Weimer; Steven E. Dicke

[57] ABSTRACT

A thermal processor and method for using the same which is particularly useful for developing a sheet of imaging material, such as photothermographic film. The thermal processor includes means for transporting the imaging material through the apparatus. The thermal processor also includes means for heating the imaging material to develop the image in the imaging material. The thermal processor also includes means for reducing fogging on the imaging material as the image is developed on the imaging material.

24 Claims, 12 Drawing Sheets

APPARATUS AND METHOD FOR THERMALLY PROCESSING AN IMAGING MATERIAL EMPLOYING MEANS FOR REDUCING FOGGING ON THE IMAGING MATERIAL DURING THERMAL PROCESSING

TECHNICAL FIELD

The present invention relates generally to an apparatus and method for thermal processing a material and more specifically an apparatus and method for thermally developing an imaging material.

BACKGROUND OF THE INVENTION

The present invention is a method and apparatus for developing sheets of light sensitive photothermographic or heat developable film. Light sensitive photothermographic film typically includes a thin polymer or paper base coated with an emulsion of dry silver or other heat sensitive material. Once the film has been subjected to photostimulation by optical means, such as laser light, it is developed through the application of heat.

Heat development of light sensitive heat developable sheet material has been disclosed in many applications ranging from photocopying apparatus to image recording/printing systems. The uniform transfer of thermal energy to the heat developable material is critical in producing a high quality printed results. The transfer of thermal energy to the film material should be conducted in a manner that will not cause introduction of artifacts. These artifacts may be physical artifacts, such as surface scratches, shrinkage, curl, and wrinkle, or developmental artifacts, such as non-uniform density and streaks. Numerous attempts to overcome the above mentioned artifacts have resulted in limited success.

The U.S. Pat. No. 4,242,566 describes a heat-pressure fusing apparatus that purports to exhibit high thermal efficiency. This fusing apparatus comprises at least one pair of first and second oppositely driven pressure fixing feed rollers, each of the rollers having an outer layer of thermal insulating material. First and second idler rollers are also included. A first flexible endless belt is disposed about the second idler roller and each of the first pressure feed rollers. A second flexible endless belt is disposed about the second idler roller and each of the second pressure feed rollers. At least one of the belts has an outer surface formed of a thermal conductive material. An area of contact exists between the first and second pressure feed rollers and allows the heat developable light sensitive sheet material to pass between two belts while under pressure. When an unfused (undeveloped) sheet of material is passed through the area of contact between two belts, the unfused sheet is subjected to sufficient heat pressure to fuse the development of the sheet of material. This apparatus, although useful for photocopying applications, will subject the sensitive material to excessive pressure. Excessive pressure can result in the formation of physical image artifacts, such as surface scratches and wrinkles, especially if the material is of polyester film construction.

In U.S. Pat. No. 3,739,143, a heat developer is described for developing light sensitive sheet material without imparting pressure to the sensitive coating while the sheet material is being heated. This developer includes a rotating drum cylinder and an electrically heated metal plate where it is partially covering the cylinder and spaced therefrom to define a space for the sheet material corresponding to the thickness of sheet material. The sheet material is guided through an opening to be wrapped around the rotating cylinder while heat is being applied by the metal plate partially covering the rotating cylinder. While this developer may satisfactorily develop paper-based heat-developable image, this developer is not well suited to develop polyester film base material having imprecise control of film heating and pressure application. In addition, the curled path can introduce curling artifacts when the polyester film material is used.

U.S. Pat. Nos. 3,629,549 and 4,518,845 both disclose developers having thermally insulating drums concentrically mounted within a heating member. Sheets of light sensitive material such as coated paper or coated polyester film are developed by being engaged by the drum and driven around the heating member. While the developers of this type may be suited well for paper coated light sensitive material, they tend to develop various artifacts in a polyester film with coated emulsion, such as scratches and nonuniform density development when the film sticks to the drum surface.

The development device disclosed in U.S. Pat. No. 3,709,472 uses a heated drum to develop strips of film. However, this device is not suitable for developing single sheets of film having soft coated emulsion layers.

U.S. Pat. No. 3,648,019 discloses another developer with a pair of heaters on opposite sides of a low thermal mass locating device, such as a screen assembly. Although portable, this developer is relatively slow and poorly suited for commercial applications.

Other photothermographic film developers include a heated drum which is electrostatically charged to hold the film thereon during development. Since the side of the film bearing the emulsion is not in contact with the drum or other developer components, it is not subject to sticking or scratching as in some of the developers discussed above. Unfortunately, the electrostatic system used to hold the film on the drum during development is relatively complicated and poorly suited for developers configured to develop larger sized sheets of film.

The U.S. Pat. No. 5,352,863 discloses a photothermographic film processor purported to be capable of quickly and uniformly developing large sheets of photothermographic film. This developer consists of an oven having a film entrance and exit; a generally flat and horizontally oriented bed of film support material mounted for movement within the oven along a film transport path between the film entrance and exit; and, a drive mechanism for driving the bed of material to transport the film through the oven along the path. The film support material, which is in the form of the padded rollers, is noted to have a sufficiently low thermal capacity to enable visible pattern-free development of the film as the film is transported through the oven. Unfortunately, this apparatus is relatively large and has not fully addressed the need to manage the thermal expansion and contraction of the imaging material to prevent, for example, wrinkling, nor the need to minimize the effect of convective currents during the thermal development of the imaging material.

In general, and as it is discussed in the background sections of the patents referenced above, the density of the developed image is dependent upon the precise and uniform transfer of heat to the film emulsion. Nonuniform heating artifact can produce an unevenly developed image density. Uneven physical contact between the film and any supporting structures during development can produce visible marks and patterns on the film surface.

It is evident that a continuing need exists for improved photothermographic film developers. In particular, there is a need for a developer capable of quickly and uniformly developing large sheets of polyester, emulsion-coated film without introducing physical and developmental artifacts that are described above.

SUMMARY OF THE INVENTION

The present invention provides an apparatus and method which addresses problems not addressed by the prior art. One embodiment of the present invention includes a thermal processor useful for thermally developing an image in an imaging material. The imaging material has a material first surface and a material second surface. The thermal processor includes at least a first and second rotatable members positioned to contact the material first surface. The thermal processor also includes means for transporting the imaging material in a first direction toward the at least first and second rotatable members. At least a third rotatable member is positioned to contact the material second surface. The at least third rotatable member is positioned relative to the at least first and second rotatable members such that the imaging material is redirected at least twice when transported between the at least first and second lower rotatable members and the at least third rotatable member. The thermal processor also includes means for heating the imaging material when the imaging material is transported between the at least first and second rotatable members and the at least third rotatable member.

Another embodiment of the present invention includes a thermal processor useful for developing an image in an imaging material which is transported along a transport path through the thermal processor. The imaging material has a material upper surface and a material lower surface. The thermal processor includes means for heating the imaging material and means for transporting the imaging material in a first direction to the heating means. The thermal processor also includes means for bending the material a plurality of times to have a plurality of curvatures when the imaging material is heated by the heating means. Each curvature has a curvature axis which is generally perpendicular to the transport path.

Another embodiment of the present invention includes a method useful for thermally developing an image in an imaging material. The imaging material has a material first surface and a material second surface. The method includes providing at least a first and second rotatable members positioned to contact the material first surface. Another step includes transporting the imaging material in a first direction toward the at least first and second rotatable members. Another step is providing at least a third rotatable member positioned to contact the material second surface. The at least third rotatable member is positioned relative to the at least first and second rotatable members such that the imaging material is redirected at least twice when transported between the at least first and second lower rotatable members and the at least third rotatable member. Another step includes heating the imaging material when the imaging material is transported between the at least first and second rotatable members and the at least third rotatable member.

Another embodiment of the present invention includes a method useful for thermally developing an image in an imaging material. The method includes transporting the imaging material into a thermal processor along a transport path and initially in a first direction. The imaging material is at a first temperature when transported into the thermal processor. Another step is heating the imaging material within the thermal processor from the first temperature to a higher developing temperature range. Another step is redirecting the imaging material within the thermal processor such that the imaging material is transported in a second direction and such that the imaging material is bent and has a first curvature when the imaging material is being heated from the first temperature towards the higher developing temperature range. The first curvature has a first curvature axis which is generally perpendicular to the transport path. Another step is redirecting the imaging material within the thermal processor from the second direction such that the imaging material is transported in a third direction and such that the imaging material is bent a second time and has a second curvature when the imaging material is being heated from the first temperature towards the higher developing temperature range. The third direction is different from the second direction. The second curvature has a second curvature axis which is generally perpendicular to the transport path. Another step is transporting the imaging material out of the thermal processor.

Another embodiment of the present invention includes a thermal processor useful for thermally developing an image in an imaging material, the imaging material having a material first surface and a material second surface. The thermal processor includes means for heating the imaging material comprising a plurality of heated surfaces within the thermal processor. The thermal processor also includes means for transporting the imaging material through the thermal processor. The thermal processor also includes means for bending the imaging material a plurality of times to have a plurality of curvatures and for positioning the imaging material adjacent to the plurality of heated surfaces when the imaging material is heated by the heating means.

Another embodiment of the present invention includes a method useful for thermally developing an image in an imaging material. The imaging material has a material upper surface and a material lower surface. The method includes providing at least one heated surface within the thermal processor. Another step is transporting the imaging material through the thermal processor and adjacent to the heated surface to heat the imaging material. Another step is positioning the imaging material adjacent to the at least one heated surface by bending the imaging material a plurality of times when the imaging material is transported through the thermal processor.

Another embodiment of the present invention includes an apparatus for thermally developing an imaging in an imaging material. The apparatus includes means for transporting the imaging material through the apparatus. Means are provided for heating the imaging material to develop the image in the imaging material. The apparatus also includes means for reducing fogging of the imaging material as the image is developed on the imaging material. A gaseous by-product may be emitted from the imaging material as the image is developed in the imaging material. The apparatus may further include means for removing at least a portion of the gaseous by-product from the apparatus.

Another embodiment of the present invention includes a thermal processor for use in developing an image in an image material. The image material is transported along a transport path through the thermal processor. The thermal processor includes a dwell section where the image is developed in the imaging material. The thermal processor further includes a heated member located below the exchanging material. The thermal processor includes means for removing air from the surface of the imaging material through the heated member, as the image is developed in the imaging material. The means for exchanging air may further comprise an exhaust air passageway located in the heated member. An exhaust fan may be mechanically coupled to the exhaust air passageway. The thermal processor may further include means for providing makeup air to the location where the image is developing. The means for providing makeup air may include a makeup air passageway. The means for providing makeup air may further comprise means for heating the makeup air to a desired temperature.

Another embodiment of the present invention includes a method useful for thermally developing an image in an imaging material. The method includes transporting the imaging material through a thermal processor along a transport path. The imaging material is heated as it passes through the thermal processor from a first temperature to a higher developing temperature. The image is developed on the imaging material. Fog on the imaging material is reduced as the image is developed in the imaging material. The step of reducing the fog may include removing a fog producing gas by-product from the thermal processor. The fog producing gas by-product may be removed along the surface of the imaging material. The step of reducing the fog may further comprise the steps of providing an exhaust air passageway in the thermal processor and removing the fog producing gas by-product through the exhaust air passageway. The method may further include the step of providing a makeup air passageway for makeup air to enter the thermal processor. The makeup air may be heated to a temperature which is approximate the temperature of the imaging material. The makeup air may be passed across an imaging surface of the imaging material as the image is developed in the imaging material.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Figure 1:
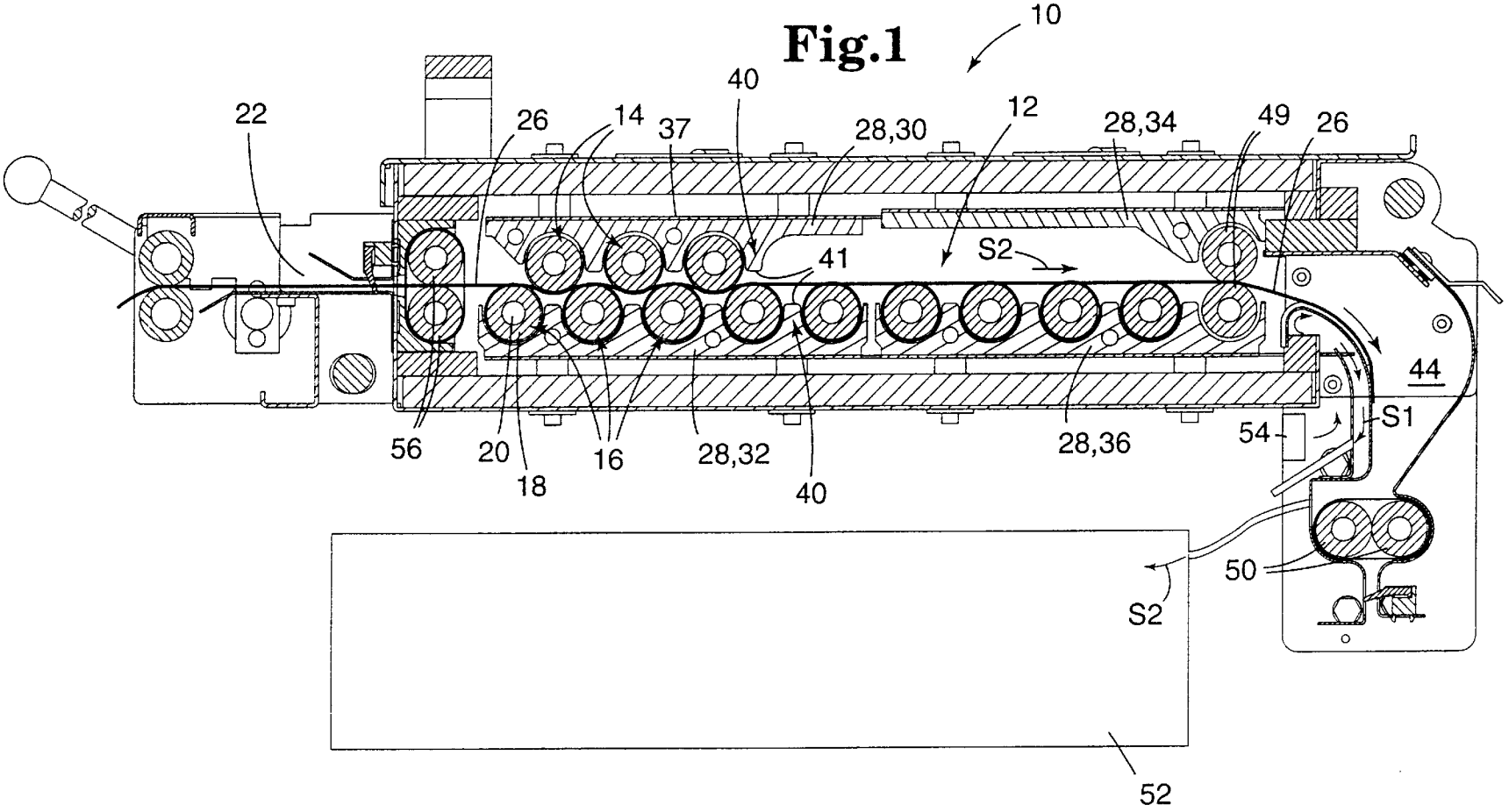
FIG. 1 is a side sectional view of one embodiment of a thermal processor in accordance with the present invention.

A thermal processor 10 in accordance with the present invention is illustrated in FIGS. 1–4 and 6. The thermal processor 10 can include a heated enclosure or oven 12 and a number of upper rollers 14 and lower rollers 16 therein.

Rollers 14, 16 can include support rods 18 with cylindrical sleeves of a support material 20 surrounding the external surface of the rods 18. The rods 18 are rotatably mounted to the opposite sides of oven 12 to orient rollers 14, 16 in a spaced relationship about a transport path between an oven entrance 22 and oven exit 24. The rollers 14, 16 are positioned to contact a thermally processable material 26 (hereinafter TPM 26), such as a thermally processable imaging material. Examples of thermally processable imaging materials include thermographic or photothermographic film (a film having a photothermographic coating or emulsion on at least one side). The term "imaging material" includes any material in which an image can be captured, including medical imaging films, graphic arts films, imaging materials used for data storage, and the like.

One or more of the rollers 14, 16 can be driven in order to drive the TPM 26 through the oven 12 and adjacent to heated members 28. Preferably, all of the rollers 14, 16 that contact the TPM 26 are driven so that the surface of each roller is heated uniformly when no TPM 26 is contacting the rollers 14, 16. As a result, the surface is maintainable within a relatively tight temperature range.

The support material 20 can be a low thermal mass, low thermal conductivity material, such as foam, such that it retains and transfers relatively insubstantial amounts of heat with respect to that generated by the oven and needed to develop the film. Using this type of material, conductive heat transfer is minimized and radiant heat transfer is accentuated. In addition, imperfections on the surface of the low thermal mass, low thermal conductivity material which contact the TPM 26 have little or no affect on the development of the TPM 26. An example of a low thermal mass, low heat conductivity material is a Willtec melamine foam having a density of 0.75 pounds per cubic foot (12.0 kg/m3) and a thermal conductivity (K) of approximately 0.30 Btu-inch per hour-foot square-degree Fahrenheit is used for support material 20, specific heat of 0.3 Btu per pound-degree Fahrenheit. Material 20 of this type is commercially available from Illbruck Corp. of Minneapolis, Minn., USA.

Other types of materials having similar or dissimilar thermal characteristics could be used, including silicone or polyimide foam. Materials of greater thermal mass and/or thermal conductivity could be used to increase the conductive heat transfer aspect and the total heat transfer, which could allow for increased throughput.

In one embodiment, the sleeves of support material 20 (melamine foam) can be about 1 inch (2.54 cm) in diameter, and fabricated by coring and grinding a block of stock to a thickness of about 0.25 inch (0.63 cm). The sleeves of material 20 are then mounted to steel rods 18. The center of the upper rollers 14 are spaced a distance D1 of approximately 1.25-inch (approximately 3.2 cm). The same is true of the lower rollers 16.

Figure 3:
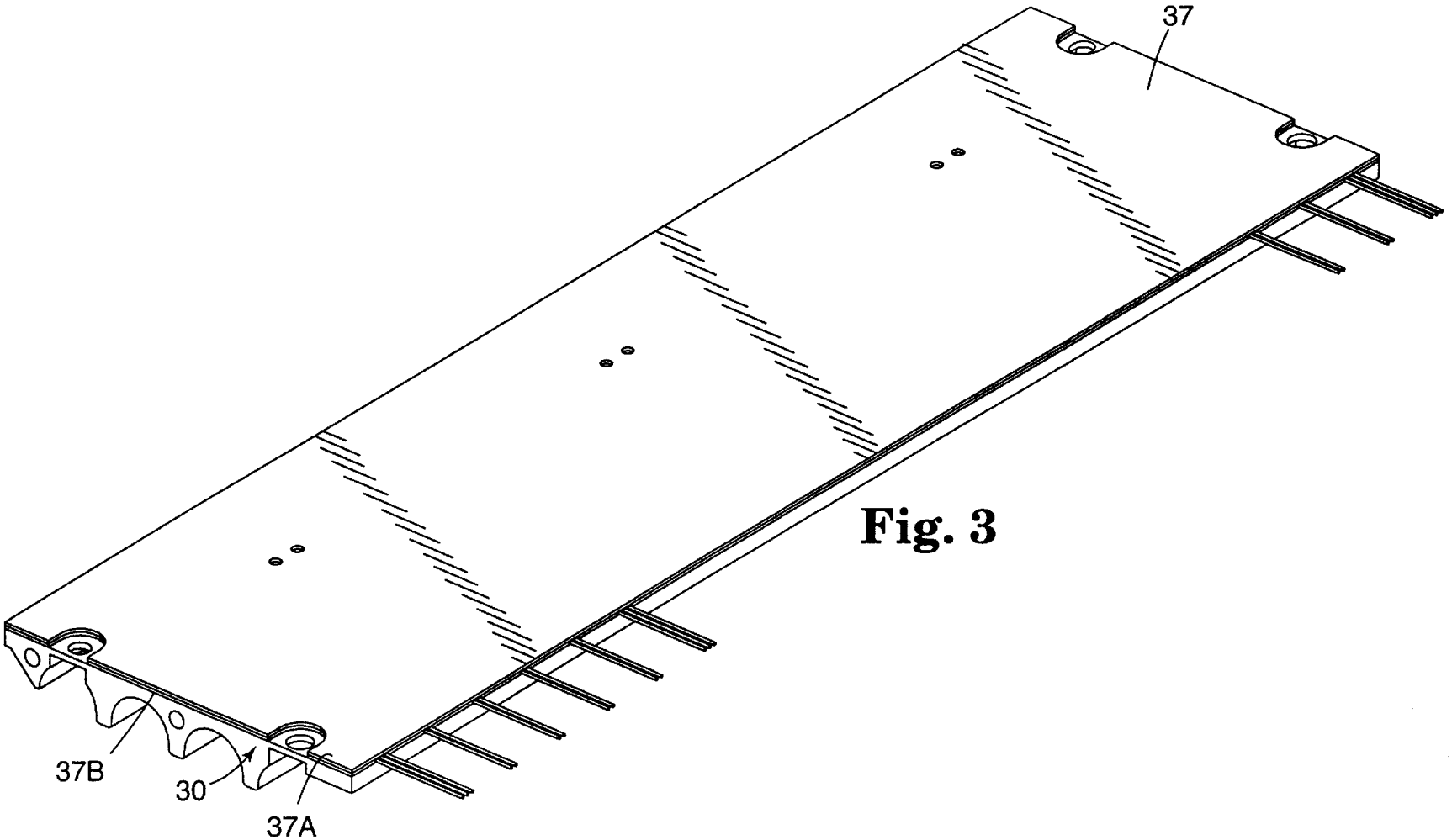
FIG. 3 is a partial side sectional view of the embodiment of the thermal processor shown in FIGS. 1 and 2.

The upper rollers 14 can be positioned, as shown, relative to the lower rollers 16 to cause the TPM 26 to be bent or curved when transported between the rollers 14, 16. Bending or curving the TPM 26 as shown in FIGS. 1 and 3 causes the TPM 26 to have a plurality of curvatures. Each of these curvatures has a curvature axis which is generally perpendicular to transport path of the TPM 26 through the oven 12. By saying "generally perpendicular", it is meant that the axis can be perpendicular to the transport path or close to being perpendicular to the transport path.

Creating these curvatures can be accomplished by positioning the rollers 14, 16 as shown in FIGS. 1 and 3. For example, the rollers 14, 16 can be positioned such that a horizontal line tangent to two or more of the lower portions of upper rollers 16 can be vertically spaced a distance D2 from a horizontal line which is tangent to two or more of the upper portions of the lower rollers 14.

Bending or curving of the TPM 26 increases the column stiffness of the TPM 26 and enables the TPM 26 to be transported through and heated up within the processor 10 without the need for nip rollers or other pressure-transporting means. Consequently, this column stiffness approach minimizes thermally-induced wrinkles of the TPM 26, which often appear in the direction of the transport path or diagonally (like an evergreen tree appearance) as a result of constraints associated with nipping (or other pressure application).

A distance D2 of approximately 0.1 inch (approximately 0.5 centimeter) has been shown to be effective when developing an 18-inch (45.7-centimeter) wide photothermographic film having, for example, a 4-mil (0.01 centimeter) polyester base. The composition of such a film is disclosed in pending U.S. pat. application Ser. Nos. 08/529,982; 08/530,024; 08/530,066; and, 08/530,744 (assigned to 3M Company, St. Paul, Minn., USA), which are hereby incorporated by reference. This photothermographic film could be one which is useful as an image-setting film, the length of which can vary from shorter sheets to longer lengths on rolls.

The distance D2, however, can be empirically determined for processing other materials, such as a 14-inch (35.6-centimeter) by 17-inch (43.2-centimeter) sheet of medical imaging film having a 7-mil (0.018 centimeter) polyester base (e.g., DRYVIEWTM DVC or DVB medical imaging film available from 3M Company, St. Paul, Minn., USA). In addition to the material choice, other factors can affect the optimal choice of the distance D2, including the width and the thickness of the material being developed, the transport rate of the material through the processor, and the heat transfer rate to the material.

The upper rollers 14 can be sufficiently spaced apart, as can the lower rollers 16, such that the TPM 26 can expand with little or no constraint in the direction generally perpendicular to the transport path. This minimizes the formation of significant wrinkles across the TPM 26 (generally perpendicular to the direction of the transport path). Furthermore, the minimization of these wrinkles can be accomplished without requiring that the TPM 26 be under tension when transported through the oven 12. This is particularly important when developing a TPM 26 of relatively short length, as opposed long length of material, such as a rollgoods material which can be pulled through the oven 12.

Four heated members 28 are shown as comprising a first upper heated member 30, a first lower heated member 32, a second upper heated member 34, and a second lower heated member 36. The heated members 28 can be heated with blanket heaters, such as the blanket heater 37 shown in FIG. 4 on the first upper heated member 30. The temperature of each blanket heater (and, therefore, heated members 28) can be independently controlled by, for example, a controller and a temperature sensor, such as a resistance temperature device or a thermocouple. Independent control of the heating elements 28 allows for more accurate control and maintenance of the temperature within the oven 12, and more critically, allows for consistent heat flow from the oven 12 to the TPMs 26 transported therethrough.

The thermal processor 10 has the ability to accurately control and maintain the temperature of the oven 12 when the oven 12 is in an idle state (no TPM 26 is being transported therethrough) and when the oven 12 is in a load state (a TPM 26 is being transported therethrough). The thermal processor 10 has the ability to compensate for the greater heat loss from the edges of the heated members 28 when in the idle state and for the additional heat loss in the inner portion of the heated members 28 when in the load state (due to heat flow to the TPM or TPMs 26).

Figure 4:
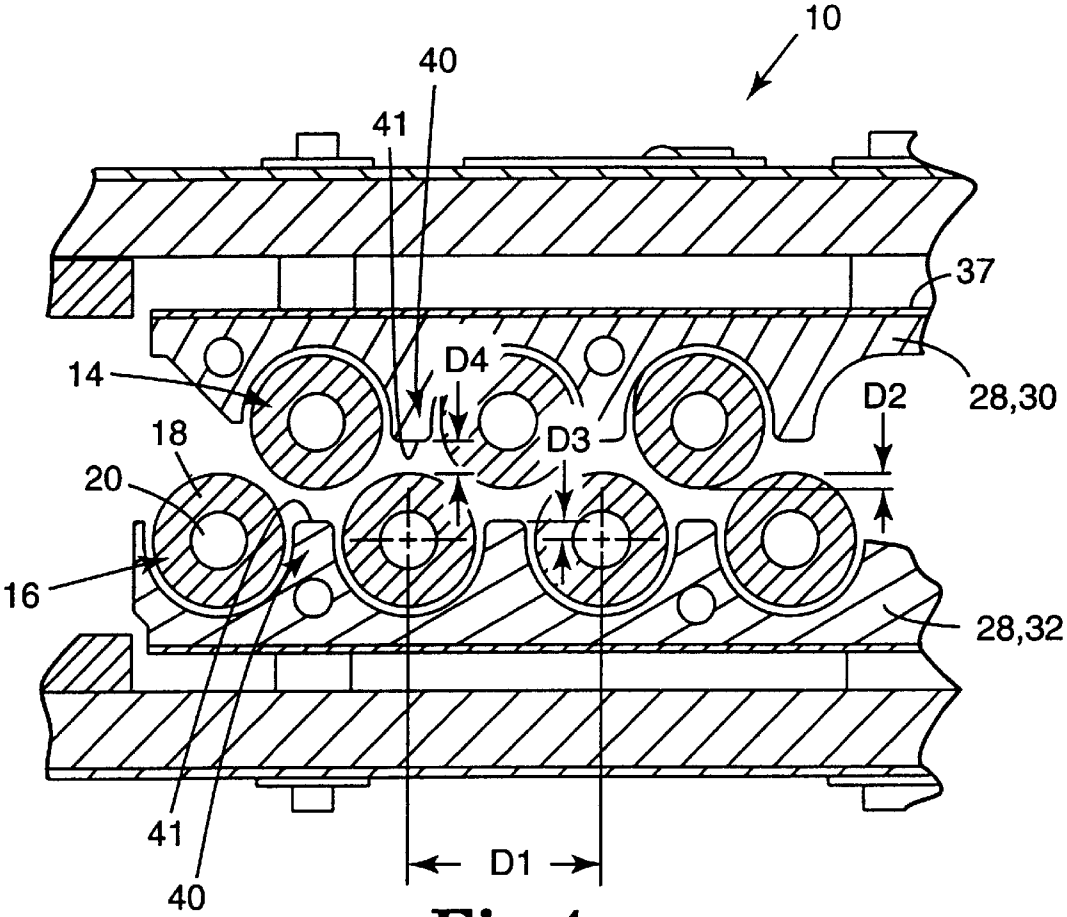
FIG. 4 is an isometric view of a top heating assembly within the embodiment of the thermal processor shown in FIGS. 1–3.

One embodiment of the thermal processor 10 that provides this ability is shown in FIG. 4 as including two blanket heaters 37 for heating a surface of a corresponding heated members 28, one blanket on top of the other. The first of the two blanket heaters 37 could be considered an idle state heater 37A which can be engaged or energized when the oven 12 is in the idle state and in the load state. The idle state heater 37A can be constructed with a particular heat flux density to distribute heat to the corresponding heated member 28 such that greater heat is created at the edges of the blanket 37A and delivered to the edges of the corresponding heated member 28 to compensate for the greater heat loss from the edges of that heated member 28. The second of the two blanket heaters could be considered a load state heater 37B which is engaged or energized when the oven 12 is in the load state. The load state heater 37B can be constructed to have a particular heat flux density to distribute heat to the corresponding heated member 28 such that greater heat is created in the inner portion of the blanket 37B and delivered to the inner portion of the corresponding heated member 28 to compensate for the heat transferred to the TPM 26. Blanket heaters of this type are available from Minco Products, Inc. which is located in Minneapolis (Fridley), Minn., USA.

In effect, this blanket heater arrangement transfers the same amount of heat to particular locations of the corresponding heated member 28 as the amount of heat transferred by those particular locations to the TPM 26. In other words, this arrangement adds heat where transferred to the TPM 26. The result is uniform temperature history of the heated members 28 during the processing of a TPM 26 such that the heat transferred to the TPM 26 is uniform and such that successive TPMs 26 are developed uniformly.

The heated members 28 can be shaped, as shown, to wrap around a circumferential portion of a number of the upper and lower rollers 14, 16. The wrap angle A can preferably range from 120 to 270 degrees of the circumference of a roller. More preferably, the wrap angle is approximately 180–200 degrees, and even more preferably, the wrap angle is approximately 190 degrees.

Another way of setting the degree to which a heated member 28 wraps around a roller is to choose the distance D3 from a heating fin 40, in particular, the fin face 41 of a heating in 40, to a plane created by the longitudinal axis of an adjacent roller. For the above-referenced rollers 14, 16, the distance D3 can be approximately 0.2 inch (0.5 centimeter), although the distance D3 could be greater or lesser.

The mating or wrapping shape and the close proximity of the heating fins 40 relative to the rollers 14, 16 more effectively maintain the temperature of the outer surface of the rollers 14, 16 as the rollers 14, 16 contact a TPM 26. This close, mating or wrapping arrangement causes the rollers 14, 16 to more uniformly transfer heat to the TPM 26.

With this wrapping arrangement, portions of the heated members 28 function as heating fins 40. The heating fins 40 fit between and relatively close to the rollers 14, 16. For example, the heating fins 40 are preferably as close as possible to the rollers 14, 16 without contact the rollers 14, 16.

By minimizing the size of the gap between the fin face 41 of a heating fin 40 and the TPM 26, radiant heat transfer efficiency and the conductive heat transfer efficiency (through a thinner layer of air) is increased. However, the size of the gap should be sufficient to prevent contact with the TPM 26 when no contact is desired, or sufficient to prevent the leading edge of a TPM 26 from catching on a heating fin 40 and possibly jamming the TPM 26 within the thermal processor 10.

The gap size between a fin face 41 and the TPM 26 can be indirectly set by choosing the distance D3 from a fin face 41 to a line tangent to a lower roller 16 positioned directly below or an upper roller 14 positioned directly above the fin face 41. For a 4-mil polyester base TPM 26, such as the previously described image-setting film, the distance D3 is preferably not significantly less than 0.2 inch (0.5 centimeter). For other materials, the minimum distance for distance D3 may be different.

The thinner layer of air within the gap also minimizes the effect of convective currents that can form and flow across the TPM 26. This, in turn, can minimize inconsistent convective heat transfer to the TPM 26 and inconsistent development of the photothermographic image.

The gap size is more consistently maintained by bending the TPM 26, as previously described, when the TPM 26 is transported adjacent to the heating fins 40. By bending the TPM 26, the increased column stiffness of the TPM 26 prevents or reduces the buckling of the TPM 26 when transported between the rollers 14, 16. And, as previously stated, this approach requires minimal pressure on the TPM 26 (e.g., no nipping of the TPM 26) as opposed means of positioning the TPM 26 relative to the fin faces 41.

The dimension and composition of the heated members 28 can be chosen to optimize their thermal mass. With optimal thermal mass, an acceptable variation of the temperature of the heated members 28 can be matched with an acceptable period of time required to heat each of the heated members 28 to a desired temperature. Minimizing the temperature variation is important as the temperature difference ($\Delta T_{rad}$) between the TPM 26 and the fin face 41 is a factor in the radiant heat transfer equation. Similarly, the temperature difference ($\Delta T_{cond}$) between the TPM 26 and the heated air adjacent to the TPM 26 is a key factor in the conductive heat transfer equation. And, maintaining the desired temperature differences ($\Delta T_{rad}$ and $\Delta T_{cond}$) is a key factor in uniform development within a TPM 26 and from one TPM 26 to the next.

To develop a length of the previously described image-setting film (TPM 26), the first upper and lower heated members 30, 32 are heated to approximately 275 degrees Fahrenheit (135 degrees Celsius) and the second upper and lower heating members 34, 36 are heated to approximately 260 degrees Fahrenheit (127 degrees Celsius). At these temperatures, the TPM 26 is preferably transported at a rate of 0.4 inch per second (1 centimeter per second). At this rate and these temperatures, the length of the first upper and lower heating members 30, 32 can preferably be approximately 6 inches (15.2 centimeters) and the length of the second upper and lower heating members 34, 36 can preferably be approximately 6 inches (15.2 centimeters).

To thermally process other thermally processable materials, these temperatures, lengths, and the transport rate can be adjusted as necessary. Similarly, to increase the throughput rate of the thermal processor 10, the transport length could be increased.

Heating the first upper and/or first lower heating members 30, 32 to higher temperatures than the second upper and/or second lower heating members 34, 36 (as noted above) provides, in essence, the oven 12 with two zones. This two-zone configuration is an effective way of increasing the throughput and minimizing the footprint of the thermal processor 10.

Within the first zone (the first zone being created by the first upper and lower heated members 30, 32, the corresponding rollers 14, 16, and the heated air adjacent to the heated members and the rollers), an amount of heat is transferred to the TPM 26 to rapidly heat the TPM 26 to within a target processing temperature range, such as approximately 240–260 degrees Fahrenheit (115–127 degrees Celsius). The transport rate of the TPM 26 through the oven 12 can be set such that the TPM temperature reaches, but does not yet exceed, the target processing temperature range when the TPM 26 is moving out of the first zone and into the second zone. (If transported more slowly through the first zone, the TPM 26 could be heated to above the target processing temperature range.)

The temperature of the second zone (second zone being created by the second upper and lower heated members 34, 36, the corresponding rollers 14, 16, and the heated air adjacent to the heated members and the rollers) can be set such that the TPM temperature is maintained within the target processing temperature range for a target dwell time. The target dwell time within the second zone is determined by the length of the second zone and by the transport rate of the TPM 26 through the second zone.

Figure 5:
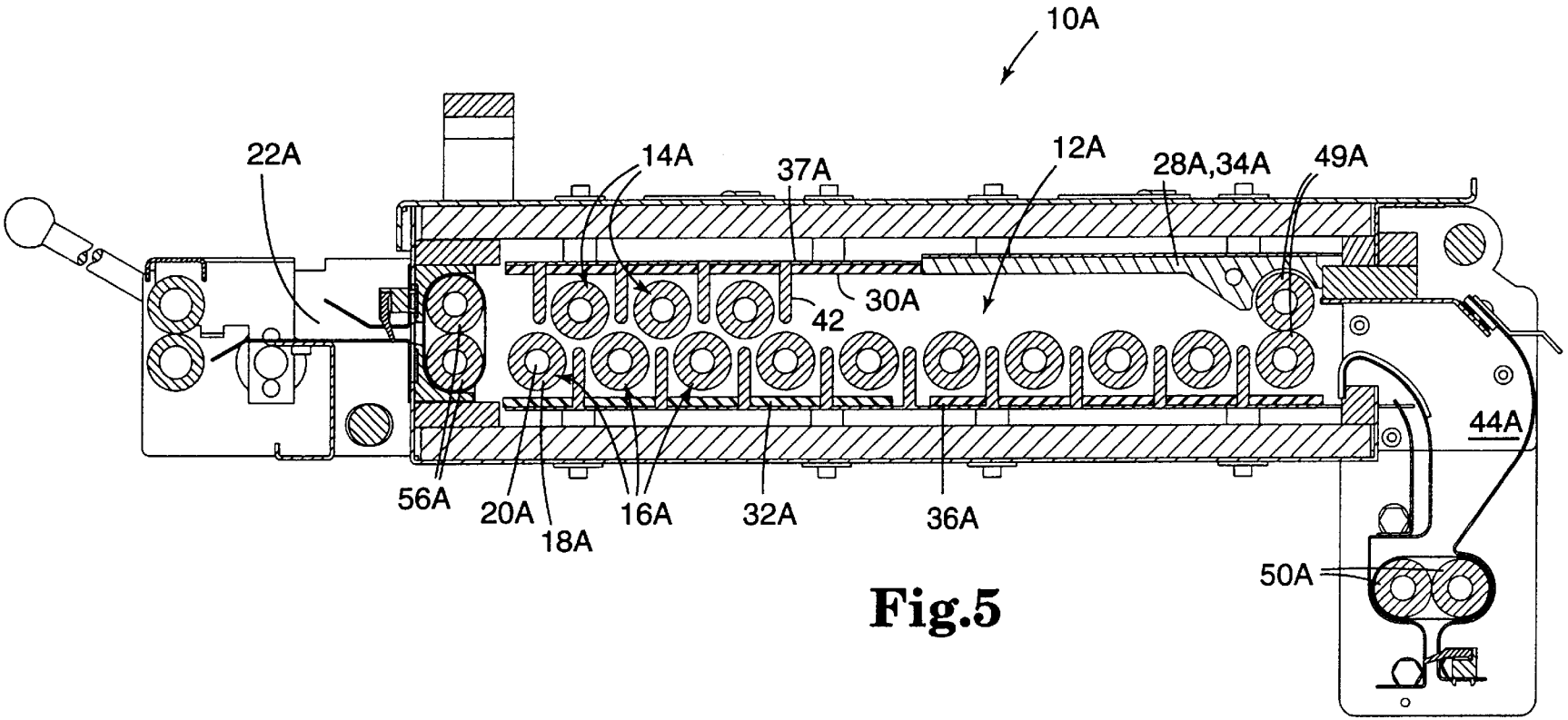
FIG. 5 is a side sectional view of another embodiment of the thermal processor in accordance with the present invention.

In FIG. 5, another embodiment of the thermal processor 10A includes screens 42A in place of the heating fins to minimize the effect of convective currents (created by the heated members 28A) on the development of the photothermographic image. The screens 42A are physical barriers positioned between many of the lower rollers 16A to stop or divert the flow of air currents along the surface of the TPM 26A (for example, the emulsion side when the emulsion side is adjacent to the lower rollers 16A). The screens 42A do not necessarily provide other advantages which are provided by the previously described heated fins 40.

Figure 2:
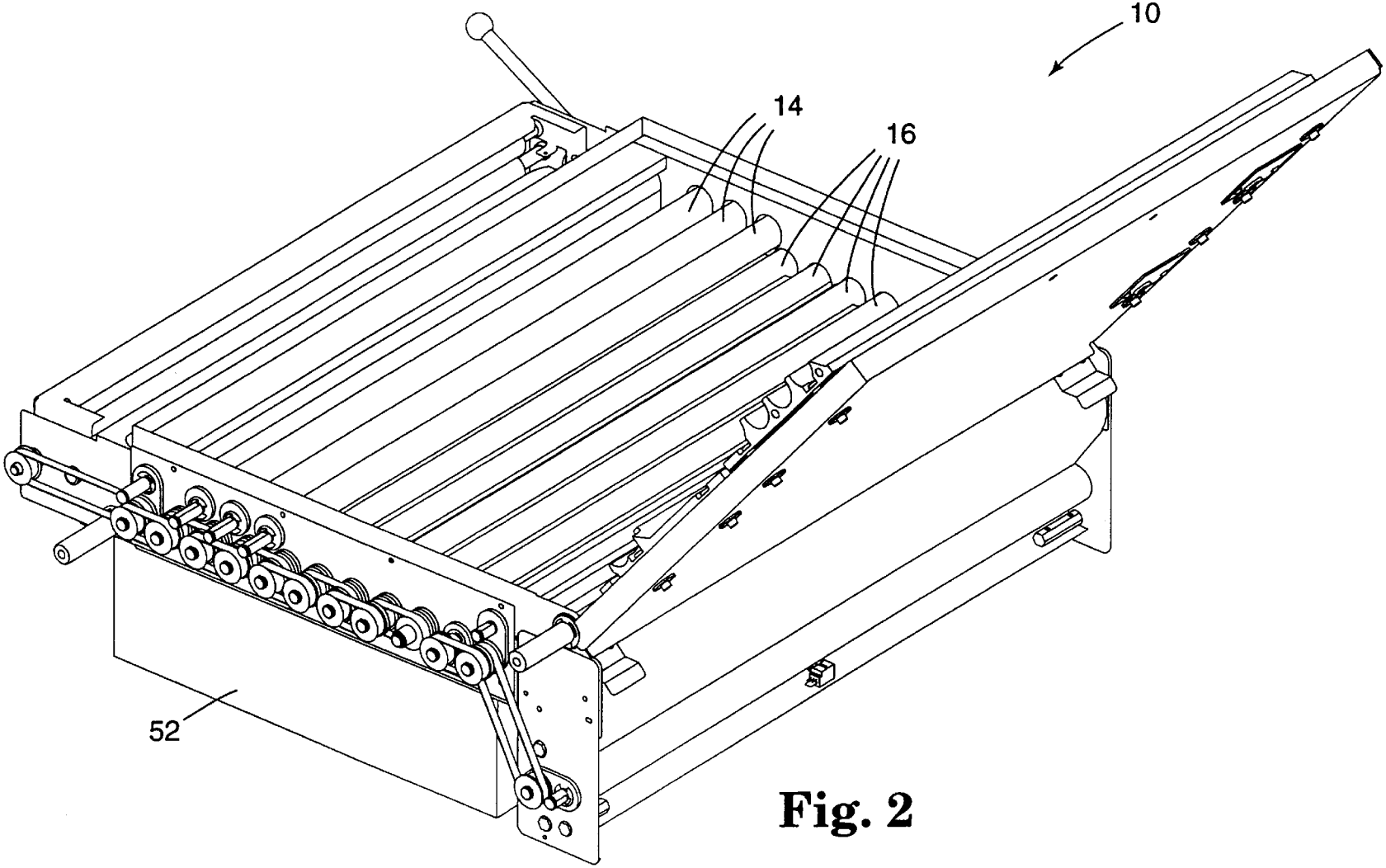
FIG. 2 is an isometric view of the embodiment of the thermal processor shown in FIG. 1 having an opened cover.

From the oven 10, the TPM 26 is transported into a cooling chamber 44, as shown in FIGS. 1 and 2. This portion of the thermal processor 10 is intended to lower the temperature of the TPM 26 to stop the thermal development while minimizing the creation of wrinkles in the TPM 26, the curling of the TPM 26, and the formation of other cooling defects.

Figure 6:
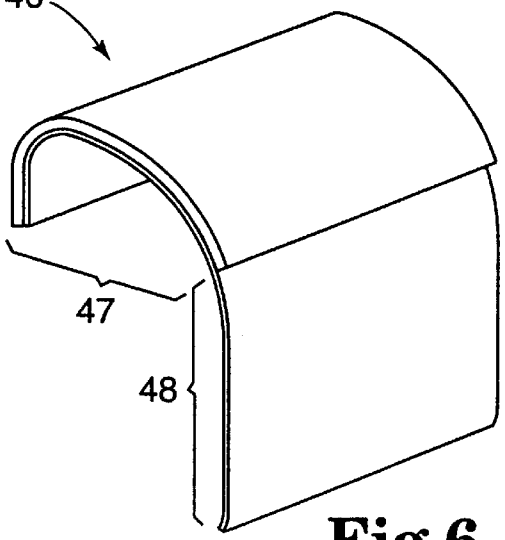
FIG. 6 is a isometric view of a cooling member within the thermal processor shown in FIGS. 1 and 5.

The cooling chamber 44 can include a cooling surface 46 (a portion of which is shown in FIG. 6) over which the TPM 26 rides. The cooling portion includes a first cooling portion 47 which is curved and a second cooling portion 48 which is relatively straight. Contact between the heated TPM 26 and the curved, first cooling portion 47 cools the TPM 26 while the TPM 26 is curved or bent. The degree of curving or bending increases the column stiffness of the TPM 26 which minimizes the formation of wrinkles. For cooling the previously mentioned image-setting film, the radius of the first cooling portion 47 where the TPM 26 contacts the first cooling portion 47 can be approximately 1.5 inches (3.8 centimeters).

The location of the first cooling portion 47 is important in that the TPM 26 is curved and be cooled by the first cooling portion 47 just after the TPM 26 exits the oven 12, that is, just after the TPM 47 is heated to the development processing temperature range for the desired dwell time. With the correct location, curvature, contact time with the TPM 26, and cooling rate caused by contact with the TPM 26, the first cooling portion 47 can cool a heated, curved TPM 26 through a temperature range which would cause wrinkling if not for the fact that the first cooling portion 47 caused the TPM 26 to be curved during this critical cooling stage. Restated, the curving or bending of the TPM 26 when the TPM 26 is most susceptible to formation of cooling-induced wrinkles significantly reduces the formation of these wrinkles.

The shape of the cooling surface 46 and the transport rate of the TPM 26 can be set such that the TPM 26 contacts the second cooling portion 48 while the TPM 26 is still cooling. Because the final cooling of the TPM 26 occurs while the TPM 26 is straight (or more straight than when contacting the first cooling portion 47), curling of the TPM 26 can be reduced.

To control the cooling rate due to contact with the cooling surface 46, the cooling surface 46 can be made of a combination of materials. Each of the materials can have a different thermal conductivity. For example, the entire cooling surface 46 can be made of a relatively high thermal conductivity material (e.g., aluminum or stainless steel). A lower thermal conductivity material (e.g., velvet or felt) can cover all or part of the first cooling portion 47 (shown as the layer between the TPM 26 and the higher thermal conductivity material).

A preferred choice for the higher thermal conductivity material is a textured, 20-gage 304 stainless steel available from Rigidized Metals Corporation, (658 Ohio St., Buffalo, N.Y. 14203). A preferred texture is referred to as Rigitex pattern 3-ND. A preferred choice for the lower thermal conductivity material is a velvet available from J. B. Martin Company, Inc. (10 East 53rd Street, Suite 3100, New York, N.Y.) and is referred to by J. B. Martin as Style No. 9120, nylon pile/rayon backed, heatseal coated, light-lock velvet.

With this construction, the TPM 26 contacts the lower thermal conductivity material and the first cooling portion 47 of the cooling surface 46 as or just after the TPM 26 exits the oven 12. Then, the TPM 26 contacts the higher conductivity material and the second cooling portion 48 of the cooling surface 46 to complete the cooling process. Proper control of the cooling rate coupled with the curving or bending of the TPM 26 during the initial cooling process results in minimized wrinkles. The choice of the radius of the first cooling portion 47 and the choice of the material can change based on the type of TPM 26 being cooled and the transport rate desired.

The TPM 26 can be transported to the cooling surface 46 with a first pair of nip rollers 49 and transported from the cooling surface 46 by a second pair of nip rollers 50. The nip rollers 49, 50 can be coordinated such that the entire TPM 26 or a significant surface area of the TPM 26 contacts the cooling surface while being transported at approximately the same rate. This causes the TPM 26 to be more uniformly cooled and the development more uniformly halted.

The thermal processor 10 can also include means for causing air flow within the cooling chamber 44. Two streams of air can be useful, one for cooling the cooling surface 46 and one for removing and filtering air within the chamber 44 and within the oven 12. The first stream S1 can be a stream of ambient air (or cooling air) which is directed at the side of the cooling surface 46 opposite to the side of the cooling surface 46 which contacts the TPM 26. The first stream S1 can be created by a first fan 54 which pulls air in from outside the thermal processor 10 and directs the air against the cooling surface 46. The air can exit to outside the thermal processor 10 through an outlet.

The first stream S1 can have a flow velocity which is suited to cool the cooling surface 46 so that the entire length of a TPM 26 is uniformly cooled and so that successive TPMs 26 are uniformly cooled. Because this flow velocity may be excessive if flowing across the TPM 26 (thereby possibly causing excessively rapid cooling of the TPM 26 which can result in wrinkles), the first stream S1 is contained to that the first stream S1 does not directly contact the TPM 26. The first fan 54 can be chosen to create a volumetric flow rate of approximately 6–10 cubic feet per minute and an air velocity against the cooling surface 46 of approximately 3–9 feet per second (0.9–2.7 meters per second).

The second stream S2 of air within the cooling chamber 44 can flow adjacent to the TPM 26 to remove the gaseous bi-products. The second stream S2 can flow through the thermal processor 10 beginning at the oven entrance 22 and terminating at a filtering mechanism 52. The flow rate of the second stream S2 can be sufficiently low that the cooling of the TPM 26 by the second stream S2 does not create a wrinkling problem. A target volumetric flow rate could be approximately one air change per minute through the thermal processor 10.

The filtering mechanism 52 can create the second stream S2 by including means for pulling air through the oven 12, such as a second fan (not shown). The filtering mechanism 52 also includes a filter (not shown) which is designed to handle the gaseous bi-products created when certain photothermographic materials are thermally developed. An example of such a filtering mechanism 52 is described in U.S. Pat. No. 5,469,238 and pending U.S. Pat. application Ser. No. 08/239,888 (assigned to 3M Company) which are hereby incorporated by reference.

A third pair of nip rollers 56 are shown near the entrance 22 of the oven 12. In addition to transporting the TPM 26 into the oven 12, the third pair of nip rollers 56 partially seal the entrance 22. The space between the third pair of nip rollers 56 and the external walls adjacent to the nip rollers 56 is sufficiently small to prevent free exchange of air in and/or out of the entrance 22. However, the space can be sufficiently large to allow just enough air to supply the second stream S2 which flows to the filtering mechanism 52. Therefore, the air flow into the oven 12 through the entrance is controlled. This can be important in preventing non-uniform development due to uncontrolled air flow against the TPM 26.

The third pair of nip rollers 56 could more completely seal off the oven entrance 22 with a tighter fit with the external walls adjacent to the third pair of nip rollers 56. This further prevents the effects of the air flow from the entrance 22 and across the TPM 26. With a complete seal, the thermal processor 10 would either be without a second stream S2 or would require another source, such as an opening in another location in the oven 12.

Another embodiment (not shown) could have the heating members 30, 32 wrapping around the third pair of nip rollers 56 in order to heat them like the other rollers 14, 16, 49 within the oven 12. This could provide even greater control of the heat being transferred to the TPM 26.

Although the present invention has been described with reference to preferred embodiments, those skilled in the art will recognize that changes may be made in form and detail without departing from the spirit and scope of the invention. For example, the transport path can have other than the horizontal, generally straight orientation which is shown (e.g., an inclined straight transport path, a vertical straight transport path, an arched transport path, and the like). Also, a greater or lesser number of rollers 14, 16 could be used within the oven 12.

Still further, other blanket heater arrangements could be used. For example, a three-layer approach could be used. The upper layer could be the idle blanket heater, like that shown. The middle layer could be a first load blanket heater having a particular heat flux density which was chosen to compensate for the heat transfer to a TPM 26 having a width of, for example, 10 inches (25.4 centimeters). The lower layer could be a second load blanket heater having a particular heat flux density which was chosen to compensate for the heat transferred to a TPM 26 having a width of, for example, 20 inches (50.8 centimeters). With this dual capability, the thermal processor 10 could include a control (manual or automatic) which engages either the first load blanket heater or the second load blanket heater depending on which TPM 26 is being transported into the thermal processor 10. Additional blanket heaters could of course be added to provide the ability to handle TPMS 26 of different widths.

Sensors, such as edge-detecting sensors, at the oven entrance 22 could be used to sense the edge locations of the incoming TPM 26 and send a signal to a controller within the thermal processor 10. The controller could be designed to determine the width of the TPM 26 based on this signal and to engage the appropriate load blanket heater. Furthermore, this sensing approach could be used with heating means other than the overlapping blanket heaters, such as a single blanket heater. Such a single blanket heater could include multiple, independently-controllable zones such that the appropriate zones could be engaged or energized to process TPMs 26 of different widths.

Figure 7:
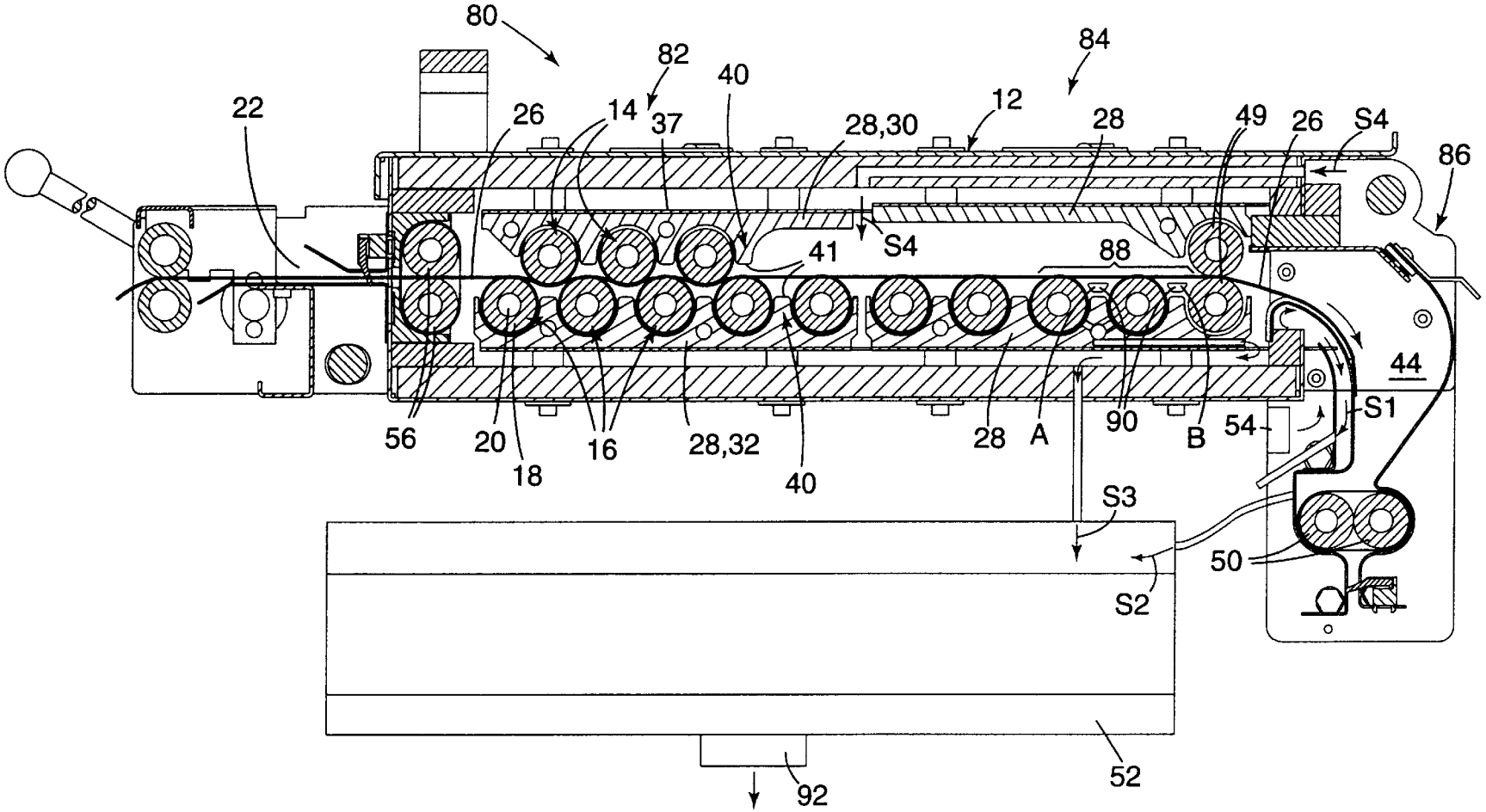
FIG. 7 is a side sectional view of another embodiment of a thermal processor in accordance with the present invention.

Referring to FIG. 7, another embodiment of the thermal processor in accordance with the present invention is generally shown at 80. The thermal processor 80 can be similar to the thermal processor 10 as previously described herein. In this embodiment, the thermal processor 80 includes an apparatus and method to reduce fogging of the image material, a phenomena which may occur as an image is thermally developed in an imaging material.

As previously described herein, the thermal processor 80 generally includes a preheat section 82, a dwell section 84, and a cooling section 86. The thermally processable material 26 follows a transport path through the preheat section 82 where it is heated to at least approach a temperature necessary for development, through the dwell section 84 where development of the thermally processable material 26 occurs, and through cooling section 86 for cooling of the thermally processable material 26. It is a known practice to develop negative images in the thermally processable material 26 as it advances through the thermal processor 10. As such, as the heated thermally processable material 26 is transported through the dwell section 84, the thermal processor 10 causes the areas of the thermally processable material 26 that were exposed to light (prior to processing) to develop and turn dark. Unexposed areas of the thermally processable material 26 remain transparent.

Under certain conditions, however, it has been found that unexposed areas of the thermally processable material can darken, and exposed areas of the thermally processable material 26 may further darken to an undesirable degree. This phenomena has become known as "fogging" of the thermally processable material. Fogging of the thermally processable material can undesirably increase the dot percentage in a percent dot exposure, or fill in large areas of the image exposed on the thermally processable material, depending on the severity of the fog.

Tests have shown that the chemistry of the thermally processable material is such that as the imaged areas are developed and turn black, a fog-producing gaseous by-product is emitted from the thermally processable material. If the gaseous by-product emitted from the thermally processable material is allowed to build up inside the thermal processor 80 and come in contact with unexposed areas of the thermally processable material 26, the gaseous by-product will fog the thermally processable material 26, resulting in unwanted developed or blackened areas.

The present invention includes an apparatus and method for reducing or eliminating fogging during development of images in the thermally processable material as it is transported through the thermal processor. In particular, the present invention includes an apparatus and method of removing the gaseous by-product which causes fogging of the thermally processable material, before reaction with the thermally processable material, without interrupting or affecting the development process. Although in one embodiment, a negative imaging process is described herein, the present invention applies equally to processes employing negative imaging or positive imaging techniques. The present invention applies to thermal processing techniques, including thermal graphic and photothermal graphic processing systems.

In FIG. 7, one embodiment of the fog reducing apparatus and method in accordance with the present invention is generally shown. In the embodiment described in detail herein, the thermally processable material 26 is transported through the thermal processor 80 with the emulsion side down. It is also recognized that the thermally processable material 26 may be transported through the thermal processor 80 with the emulsion side up, which will be described later in the specification.

In general, as the thermally processable material 26 is transported through the dwell section 84, in response to the heat, the image is developed in the thermally processable material and turns dark. This occurs in the latter part of the dwell section 84, indicated as developing section 88. As the imaged areas on the thermally processable material 26 darken, a fog-producing gaseous by-product 90 (indicated as a cloud) is emitted from the thermally processable material 26 (shown as fog region A and fog region B).

Before the fog-producing gaseous by-product 90 damages or "fogs" the thermally processable material 26, the gaseous by-product 90 is evacuated from the thermal processor dwell section 84. In operation, the gaseous by-product 90 is evacuated from the dwell section 84, indicated by arrows S3, through filtering mechanism 52 using exhaust fan 92. The gaseous by-product 90 is replaced by fresh makeup air brought into the dwell section 84, indicated by arrows S4. As the makeup air is brought into the dwell section 84, it is heated to the approximate temperature of the thermally processable material 26, such that it will not affect the development of thermally processable material 26.

Figure 8:
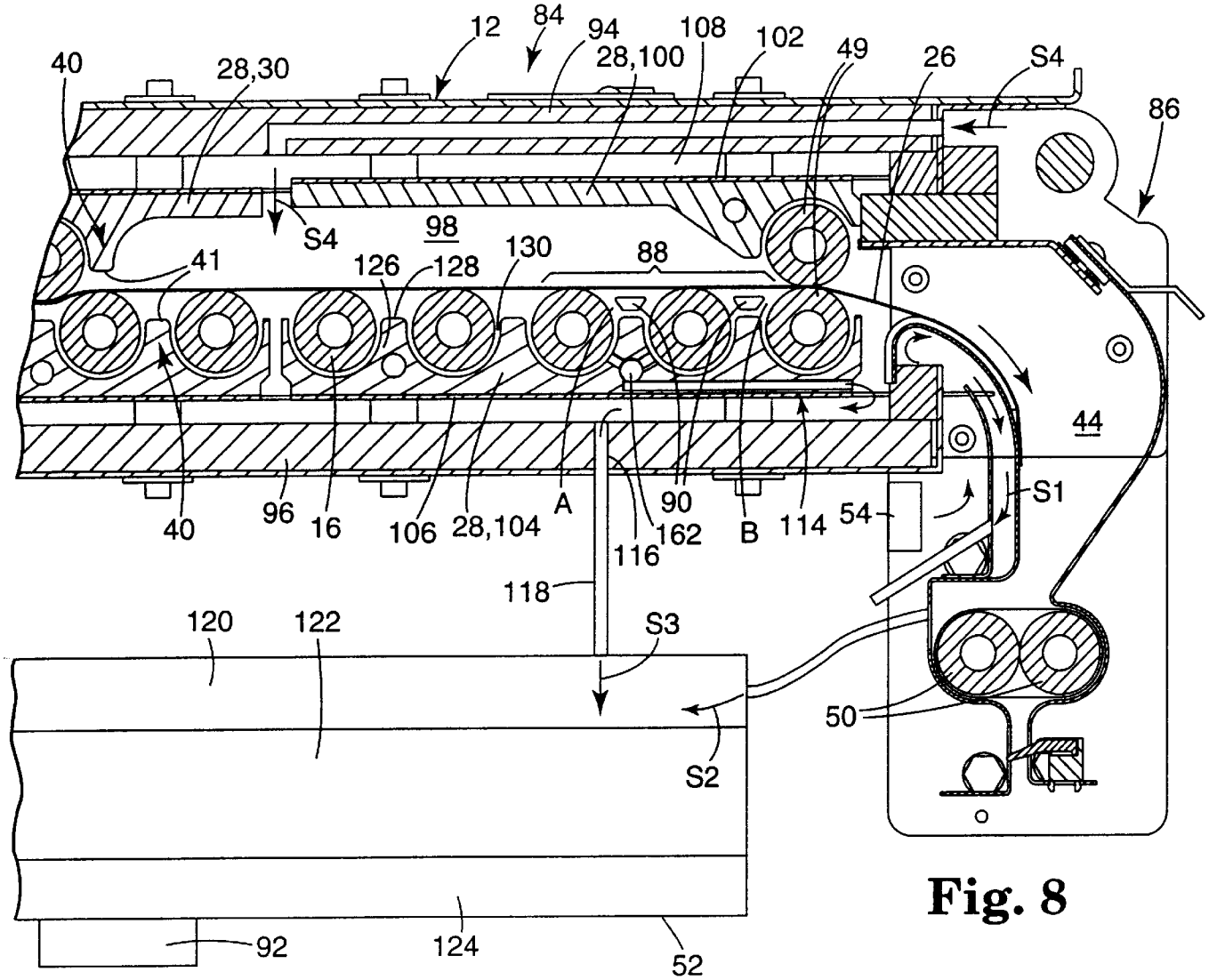
FIG. 8 is an enlarged partial side sectional view of the embodiment of the thermal processor shown in FIG. 7.

Referring to FIG. 8, an expanded side sectional view of the dwell section 84 of the thermal processor 80 is shown. Heated enclosure or oven 12 includes a top insulation layer 94 and a bottom insulation layer 96. Within dwell section 84, a heated dwell chamber 98 is enclosed by an upper heated member 100 thermally coupled to a heating blanket 102, and a lower heated member 104 thermally coupled to a lower blanket heater 106. Top insulation layer 94 includes a makeup air passageway 108 which allows fresh makeup air from a location outside the oven 12 to enter the dwell chamber 98.

Lower heated member 104 includes a plurality of exhaust air passageways 114 (one shown). One embodiment of the exhaust air passageways 114 is described in detail later in the specification. Further, bottom insulation layer 96 includes an air passageway 116. The air passageway 116 is coupled to filtering mechanism 52 through a tubular member 118. The filtering mechanism 52 is in communication with exhaust fan 92. In one embodiment, the filtering mechanism 52 is a carbon filtering mechanism, which includes a first plenum 120, a carbon filter 122, and a second air plenum 124.

In one embodiment, heated member 104 is formed of aluminum. Heated member 104 generally includes a plurality of heating fins 126, having fin faces 128, adjacent curved regions 130. Rollers 16 nest within the curved regions 130, as previously described herein. A longitudinal exhaust air passageway 162 extends longitudinally through the lower heated member 104. The cross sectional area of a single exhaust air flow channel through a longitudinal exhaust air passageway, for example, as formed by the thermally processable material 26, roller 16, and a fin face 128, is approximately 0.02 inches squared. Exhaust fan 92 has a 7.9 watt, 12 volt DC rating as manufactured by Comair. The exhaust fan 92 has a total volumetric flow of eight cubic feet per minute.

Figure 9:
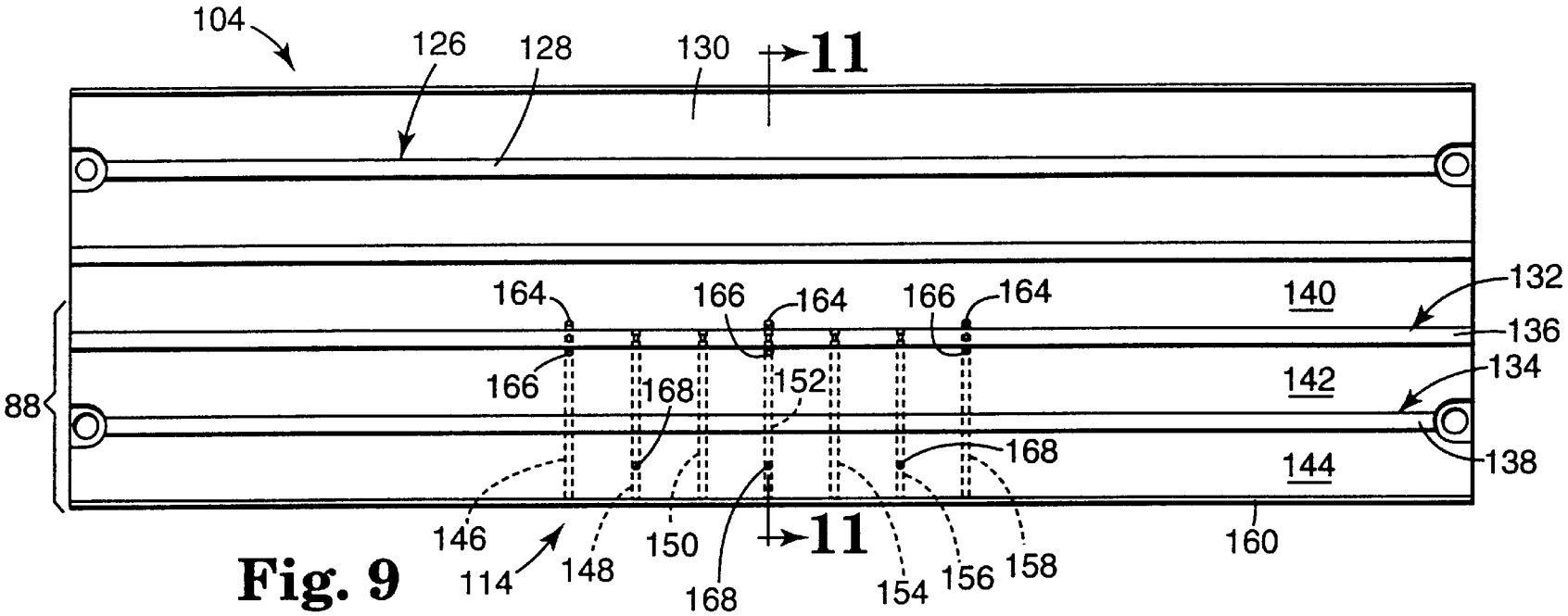
FIG. 9 is a top view of the lower heated member shown in FIG. 7.

Referring to FIG. 9, a top view of heated member 104 is shown. The heating fins 126, fin faces 128 and curved regions 130 extend longitudinally across lower heated member 104. Within developing area 88, the lower heated member 104 specifically includes heating fin 132, heating fin 134, fin face 136, fin face 138, curved region 140, curved region 142, and curved region 144.

Exhaust air passageways 114 are centrally located within the heated member developing area 88. For example, in the embodiment shown, the exhaust air passageways 114 include a first exhaust air passageway 146, a second exhaust air passageway 148, a third exhaust air passageway 150, a fourth exhaust air passageway 152, a fifth exhaust air passageway 154, a sixth exhaust air passageway 156, and a seventh exhaust air passageway 158. Each exhaust air passageway 114 is generally tubular shaped and extends between an edge 160 of lower heated member 104 and the longitudinal exhaust air passageway 162 (shown in FIG. 11). First exhaust air passageway 146, fourth exhaust air passageway 152, and fifth exhaust air passageway 158 include a first port 164 opening into curved region 140 and a second port 166 opening into curved region 142. Second exhaust air passageway 148, fourth exhaust air passageway 152, and sixth exhaust air passageway 156 include a proximal port 168 opening into curved region 144.

Figure 10:
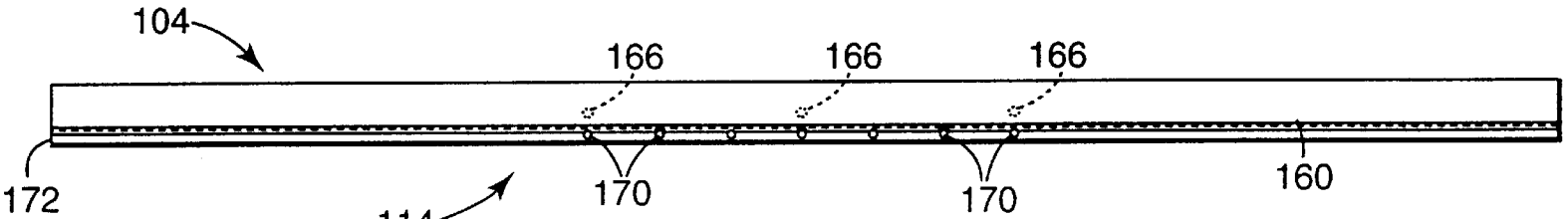
FIG. 10 is an end view of the lower heated member shown in FIG. 7.

Referring to FIG. 10, each exhaust air passageway 114 includes an opening 170 along the edge 160. In one example, the exhaust air passageways 114 are located 25.4 mm apart on center, with the first exhaust air passageway 146 being located 190.5 mm from an edge 172 of the lower heated member 104.

Figure 11:
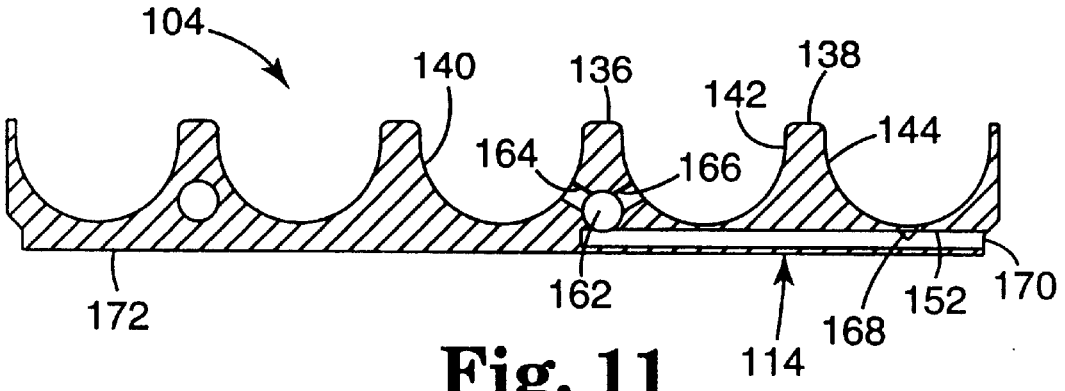
FIG. 11 is a sectional view taken along line 11—11 of FIG. 9.

Referring to FIG. 11, a cross-sectional view of the lower heated member 104 taken along line 11—11 of FIG. 9 is shown. In the example shown, the fourth exhaust air passageway 152 extends 63.6 mm between edge 160 and longitudinal exhaust air passageway 162. The fourth exhaust air passageway 152 is generally tubular shaped having an inside diameter of approximately 2.79 mm, and includes an opening into proximal port 168 and longitudinal exhaust air passageway 162. The proximal port 168 has a relatively short tubular shape with an approximate inside diameter of 2.79 mm, and opens proximate the mid-point of curved region 144. First port 164 and second port 166 are generally tubular shaped having an inside diameter of 3.25 mm. First port 164 and second port 166 extend outward from the longitudinal exhaust air passageway 162, in communication with the curved region 140 and the curved region 142, respectively, at an approximate angle of 30° relative to the horizontal plane, wherein the horizontal plane is defined by a bottom surface 172 of the lower heated member 104.

Figure 12:
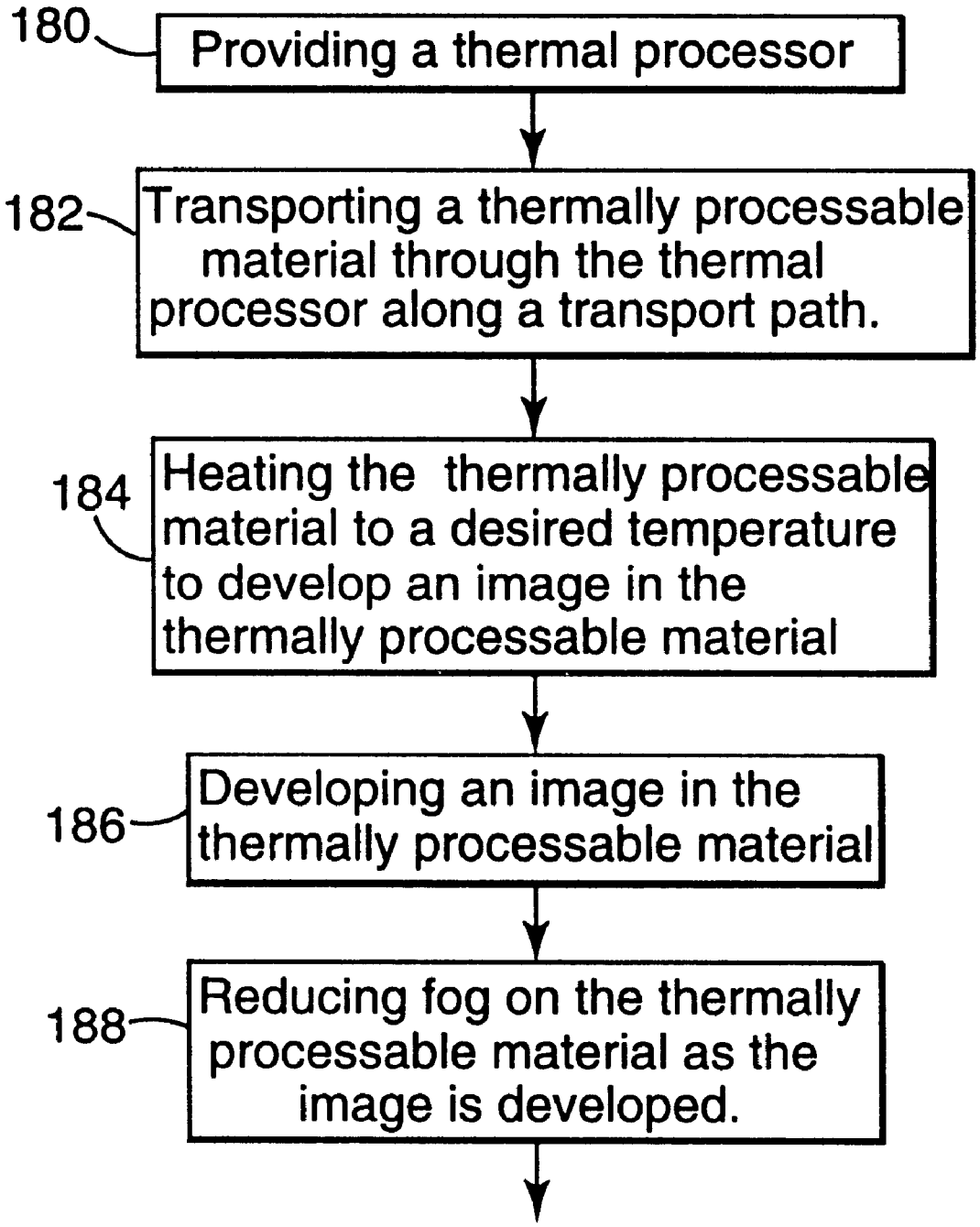
FIG. 12 is a process block diagram showing one method of operation of the thermal processor in accordance with the present invention.

In operation, the present invention includes a method for reducing fog on the thermally processable material 26. Referring to the process diagram of FIG. 12, the method includes providing a thermal processor (180). The thermally processable material 26 is transported through the thermal processor 80 along a transport path (182). The thermally processable material 26 is heated as it passes through the thermal processor 80 from its first initial temperature to a relatively higher developing temperature (184). The image is developed on the thermally processable material 26 (186). The method further includes reducing fog on the thermally processable material 26 as the image is developed on the thermally processable material 26 (188).

Figure 13:
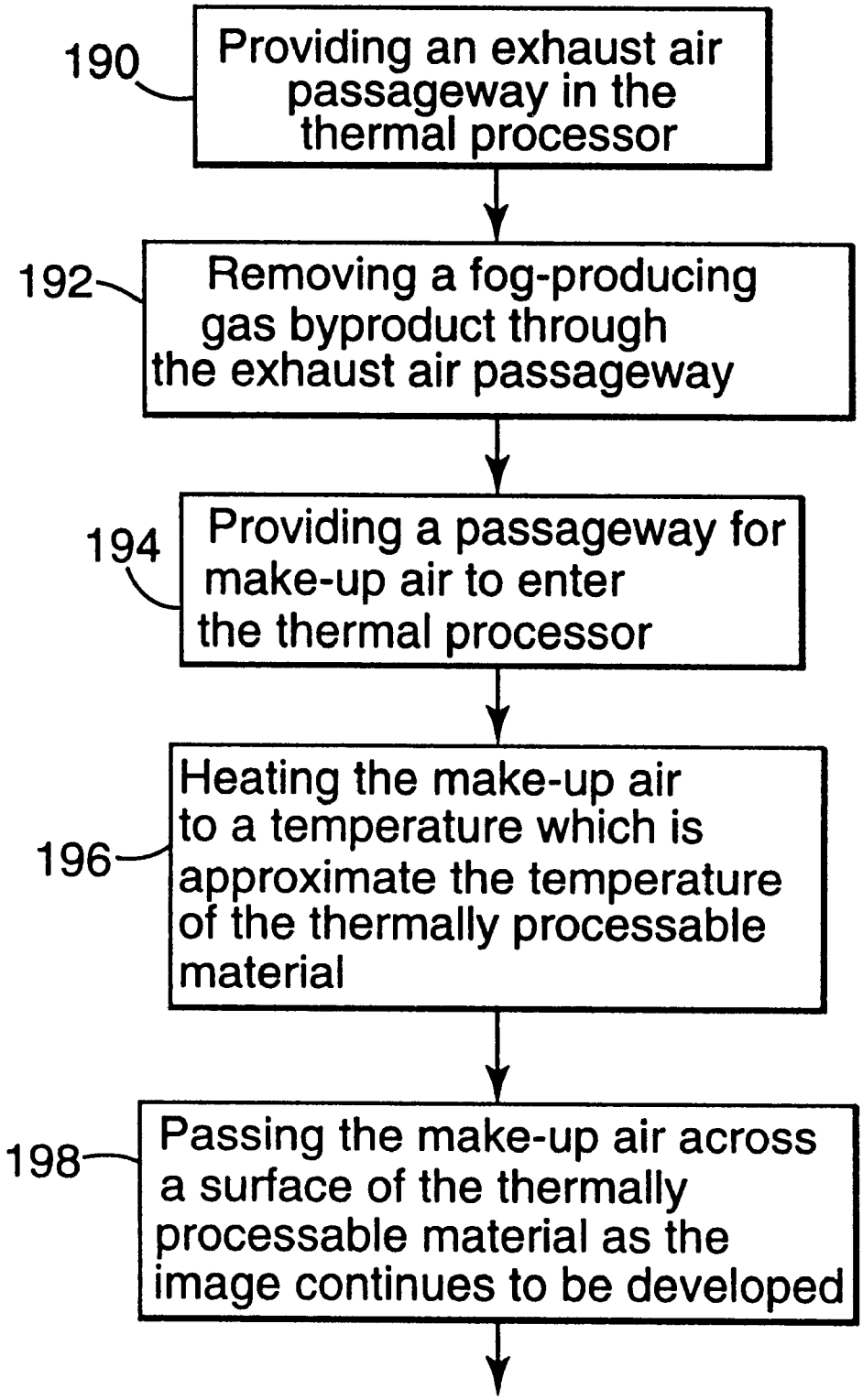
FIG. 13 is a process block diagram showing another method of operation of the thermal processor in accordance with the present invention.

Referring to FIG. 13, the method of reducing the fog on the thermally processable material 26 as the image is developed may further include providing an exhaust air passageway in the thermal processor 80 (190). Air is exchanged adjacent the film surface. A fog-producing gas by-product is removed from the thermal processor through the exhaust air passageway 114 (192). It is recognized that the fog-producing gas by-product 90 may be removed through the exhaust air passageway 114 through the use of exhaust fan 92, which causes the gaseous by-product 92 flow from the thermal processor 80. The makeup air passageway 108 is provided for allowing fresh makeup air S4 to enter the dwell section chamber 85 of the thermal processor 80 (194). As the fresh makeup air S4 passes through the makeup air passageway 108 and into the dwell section chamber 85, the fresh makeup air S4 is heated to a temperature which is approximate the temperature of the thermally processable material 26 (196). In one embodiment, the fresh makeup air S4 is directed along a path across the surface of the thermally processable material 26, generally perpendicular to the direction of movement of the thermally processable material 26, as images continue to be developed on the thermally processable material 26 for continuous removal of the fog-producing gaseous by-product 90 (198).

Figure 14:
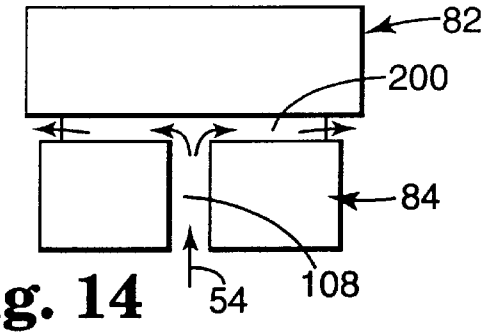
FIG. 14 is a schematic diagram showing one embodiment of makeup air flow through the thermal processor shown in FIG. 7.

Referring to FIG. 14, a schematic diagram showing the general air flow of the makeup air as it enters the thermal processor 80 is shown. The direction of the makeup air flow is represented by arrows S4. In operation, fresh makeup air S4 passes through makeup air passageway 108. As the makeup air exits the makeup air passageway 108, it travels downward and across a gasket seal 200 between the preheat section 80 and the dwell section 84. The gasket seal 200 is approximately the width of the thermally processable material 26 and seals between the preheat section 82 and dwell section 84. Upon reaching the edges of the gasket seal 200, the makeup air S4 continues downward through the dwell chamber 85.

Referring again to FIGS. 7 and 8, during operation of the thermal processor 80, air is exchanged adjacent the thermally processable material 26 and the gaseous by-product 90 is evacuated from the thermal processor 80, thereby reducing fogging of the thermally processable material 26. Exhaust fan 92 is operated to create a negative air pressure within the thermal processor 80, drawing air from the thermal processor dwell section 84. In one preferred embodiment, air is moved in a direction generally perpendicular to the movement of the thermally processable material 26. Upon operation of exhaust fan 92, makeup air is drawn in through makeup air passageway 108, indicated by arrow S4, through top insulation area 94, and into the dwell section chamber 85. Since the temperature within the dwell section 84 is approximately 260° F., it is desirable to heat the fresh makeup air to a temperature which is approximate the temperature of the dwell section 84. The makeup air is heated as the makeup air passes through the makeup air passageway 108. Further, the makeup air continues to heat to a higher temperature as it is passes upper blanket heater 102 and upper heated member 100.

Figure 15:
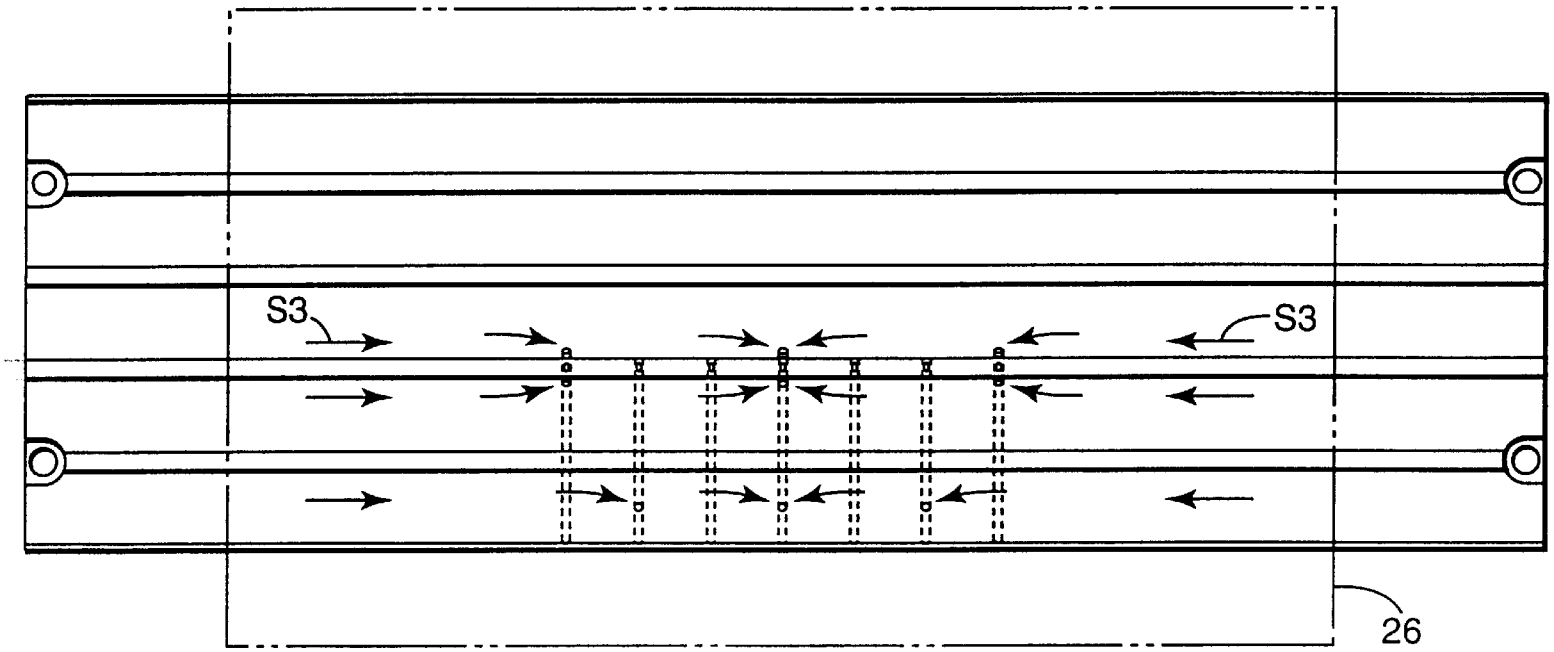
FIG. 15 is a schematic diagram showing one embodiment of exhaust air flow through the thermal processor of FIG. 7.

Referring to FIG. 15, a schematic diagram showing the directional flow of the exhaust air currents S3 and the removal of gaseous by-product 90 through the exhaust air passageways 114 is shown. Since the fog-producing gaseous by-product 90 is liberated from the thermally processable material 26 during development of an image in the thermally processable material 26, the fog-producing gaseous by-product 90 is mainly present within developing area 88. When the thermally processable material 26 is transported through the thermal processor 80 (indicated by directional arrow 202) with the emulsion side down, the fog-producing gaseous by-product 90 is mainly present within fog region A and fog region B (indicated in FIG. 7).

In a preferred embodiment, air is exhausted at a velocity along the surface of the thermally processable material 26 sufficient to exhaust the fog-producing gaseous by-product 90 before any fog is produced on the thermally processable material 26. Air adjacent the thermally processable material is exchanged, with the exhausted air continuously being replaced by fresh makeup air having a temperature which is approximate the temperature of the thermally processable material 26. Since the air moving across the surface of the thermally processable material 26 is heated to a temperature which is approximate the temperature of the thermally processable material 26, the development of the thermally processable material 26 is not affected by the air movements. Further, since the air movements are restricted to passage along the surface of the thermally processable material 26 in region A and region B only, other processes within the thermal processor 80 are not affected by air movement.

In one preferred embodiment shown, air is drawn along the bottom surface of the thermally processable material 26 and evacuated near the center region of the lower heated member 104. Further, air is evacuated within both fog region A and fog region B. It is also recognized that other patterns may be used for creating air currents along the emulsion surface of the thermally processable material 26 during development of an image in the material, and subsequent evacuation of the fog-producing gaseous by-product while remaining with the scope of the present invention.

It is recognized that the present invention may also be used for removing fog-producing gaseous by-product 90 from the oven 12 while thermally processable material is being processed within the thermal processor 80 with the emulsion side up. With this method of operation, it has been found that it may be necessary or at least preferred to add additional openings along the center area of gasket seal 200 (shown in FIG. 14). It is also recognized that the fog-producing gaseous by-product may be evacuated from the top of thermal processor 80, through the use of an exhaust fan located on the top of the thermal processor 80 or by using a fan to push the air through the thermal processor 80. It is also recognized that the makeup air S4 may be preheated to a desired temperature before it enters the oven 12, to further aid in increasing the temperature of the makeup air S4 to a temperature which is approximate the temperature of the thermally processable material 26.

It will be understood that the disclosed embodiments are, in many respects, only illustrative. Changes may be made in details, particularly in matters of shape, size, material, and arrangement of parts, without exceeding the scope of the invention. Accordingly, the scope of the invention is as defined in the language of the appended claims.

What is claimed is:

1. An apparatus for thermally developing an image in an imaging material, the apparatus comprising:

means for transporting the imaging material through the apparatus;

means for heating the imaging material by radiant and conductive heat transfer to develop the image in the imaging material;

means for reducing fogging of the imaging material as the image is developed in the imaging material; and wherein as the image is developed in the imaging material a gaseous byproduct is emitted from the imaging material, and wherein the means for reducing fogging further comprises means for removing at least a portion of the gaseous byproduct from the apparatus, wherein the apparatus further comprises means for providing make-up air to the apparatus, wherein the means for providing make-up air to the apparatus comprises a make-up air passageway further comprising means for heating the make-up air to a temperature which is approximate the temperature of the imaging material, and means for passing the make-up air across the imaging material at the location where the gaseous byproduct is emitted.

2. The apparatus of claim 1, wherein the means for removing the gaseous byproduct comprises:

an exhaust air passageway; and an exhaust fan coupled to the exhaust air passageway.

3. The apparatus of claim 1, wherein means for heating the imaging material comprises two stages, wherein a first stage preheats the imaging material to within a predetermined target processing temperature range, and a second stage maintains the target processing temperature range for a predetermined target dwell time.

4. The apparatus of claim 1, wherein the imaging material includes an emulsion surface and the means for removing the gaseous byproduct includes moving air across the emulsion surface at a sufficient flow rate to reduce fogging.

5. An apparatus for thermally developing an image in an imaging material, the apparatus comprising:

means for transporting the imaging material through the apparatus;

means for heating the imaging material by radiant and conductive heat transfer to develop the image in the imaging material;

means for reducing fogging of the imaging material as the image is developed in the imaging material;

wherein as the image is developed in the imaging material a gaseous byproduct is emitted from the imaging material, and wherein the means for reducing fogging further comprises means for removing at least a portion of the gaseous byproduct from the apparatus, wherein the apparatus further comprises means for providing make-up air to the apparatus, wherein the means for providing make-up air to the apparatus comprises a make-up air passageway; and wherein the apparatus further comprises means for preheating the make-up air before it enters the make-up air passageway to a temperature which is approximate the temperature of the imaging material.

6. The apparatus of claim 5, wherein means for heating the imaging material comprises two stages, wherein a first stage preheats the imaging material to within a predetermined target processing temperature range, and a second stage maintains the target processing temperature range for a predetermined target dwell time.

7. A thermal processor for use in developing an image in an imaging material which is transported along a transport path through the thermal processor, the thermal processor having a dwell section where the image is developed in the imaging material, wherein thermal process comprises:

a heated member located adjacent the imaging material, wherein the heated member heats the imaging material by radiant and conductive heat transfer; and means for exchanging air from the surface of the imaging material through the heated member, as the image is developed in the imaging material.

8. The thermal processor of claim 7, wherein means for exchanging air further comprises an exhaust air passageway located in the heated member.

9. The thermal processor of claim 8, wherein means for exchanging air further comprises an exhaust fan mechanically coupled to the exhaust air passageway.

10. The thermal processor of claim 9, further comprising a filter, wherein the exhaust fan is mechanically coupled to the exhaust air passageway through the filter.

11. The thermal processor of claim 8, wherein means for exchanging air includes a plurality of exhaust air passageways.

12. The thermal processor of claim 11, wherein the heated member includes a central portion, and further wherein the exhaust air passageways are located along the central portion of the heated member.

13. The thermal processor of claim 12, wherein the exhaust air passageways include a distal end and a proximal end, and wherein at least one of the exhaust air passageways has a port opening proximate the distal end.

14. The thermal processor of claim 13, further wherein at least one of the exhaust air passageways has a port opening distal of the proximal end.

15. The thermal processor of claim 7, further comprising means for providing make-up air to the location where the image is developing.

16. The thermal processor of claim 15, wherein the means for providing make-up air includes a make-up air passageway.

17. The thermal processor of claim 15, wherein the means for providing make-up air further comprises means for heating the make-up air to a desired temperature.

18. A method useful for thermally developing an image in an imaging material, the method comprising the steps of:

transporting the imaging material through a thermal processor along a transport path;

heating the imaging material by radiant and conductive heat transfer as it passes through the thermal processor from a first temperature to a higher developing temperature;

developing an image in the imaging material; and reducing a fog on the imaging material as the image is developed in the imaging material, including the step of removing a fog producing gas byproduct from the thermal processor by providing a make-up air passageway for make-up air to enter the thermal processor; and heating the make-up air to a temperature which is approximate the temperature of the imaging material.

19. The method of claim 18, wherein the fog producing gas byproduct is removed along the surface of the imaging material.

20. The method of claim 18, wherein reducing the fog further comprises the steps of:

providing an exhaust air passageway in the thermal processor; and removing the fog producing gas byproduct through the exhaust air passageway.

21. The method of claim 18, wherein reducing the fog further comprises the step of passing the make-up air across an imaging surface of the imaging material as the image is developed in the imaging material.

22. The method of claim 18, wherein heating the image material comprises two stages, wherein a first stage preheats the imaging material to within a predetermined target processing temperature range, and a second stage maintains the target processing temperature range for a predetermined target dwell time.

23. An apparatus for thermally creating an image in an imaging material, the apparatus comprising:

means for transporting the imaging material through the apparatus;

means for heating the imaging material by radiant and conductive heat transfer to create the image in the imaging material; and means for reducing fogging of the imaging material as the image is created in the imaging material, including means for supplying air across an emulsion surface of the imaging material, wherein the air is heated to a temperature which is approximate the temperature of the imaging material.

24. The apparatus of claim 23, wherein the air is supplied across the emulsion surface of the imaging material in a direction substantially perpendicular to the direction of movement of the imaging material.

* * * * *